US007644467B2

(12) United States Patent
Kleinhammer

(10) Patent No.: US 7,644,467 B2
(45) Date of Patent: Jan. 12, 2010

(54) FILLER MATERIAL FINISHING TOOL

(76) Inventor: John W. Kleinhammer, 1000 Park Ave., Cayucos, CA (US) 93430

( * ) Notice: Subject to any disclaimer, the term of this patent is extended or adjusted under 35 U.S.C. 154(b) by 489 days.

(21) Appl. No.: 11/296,838

(22) Filed: Dec. 6, 2005

(65) Prior Publication Data

US 2007/0124884 A1 Jun. 7, 2007

(51) Int. Cl.
*B05C 17/10* (2006.01)
*E04F 21/165* (2006.01)

(52) U.S. Cl. ..... 15/235.7; 15/104.001; 15/244.1; 15/245.1; 425/458; D8/45

(58) Field of Classification Search ..... 15/104.001, 15/235.3, 235.7, 244.1, 244.4, 245.1, 424, 15/425; 425/458; D8/45
See application file for complete search history.

(56) References Cited

U.S. PATENT DOCUMENTS

| | | | | | |
|---|---|---|---|---|---|
| 447,873 | A | * | 3/1891 | Hanimann | 15/427 |
| 1,000,333 | A | | 8/1911 | Hall | |
| 1,703,785 | A | | 2/1929 | Shuttleworth | |
| 1,851,497 | A | | 3/1932 | Darling | |
| 2,247,603 | A | | 7/1941 | Christman | |
| 2,247,604 | A | | 7/1941 | Christman | |
| 3,058,139 | A | * | 10/1962 | Dryden | 15/244.1 |
| 3,087,654 | A | | 4/1963 | Moore | |
| 3,498,101 | A | | 3/1970 | Daniell | |
| 3,611,469 | A | | 10/1971 | Belli | |
| 3,744,079 | A | | 7/1973 | Krause | |
| 3,761,992 | A | | 10/1973 | Schneller | |
| 3,821,828 | A | | 7/1974 | Pearson | |
| 3,846,060 | A | | 11/1974 | Otis | |
| 3,878,581 | A | | 4/1975 | Perna | |
| 4,211,501 | A | | 7/1980 | Pedroso et al. | |
| 4,586,890 | A | | 5/1986 | Marchbanks | |
| 4,673,346 | A | | 6/1987 | Anderson | |
| 4,825,597 | A | * | 5/1989 | Matechuk | 451/524 |
| 5,017,113 | A | | 5/1991 | Heaton et al. | |
| 5,018,956 | A | | 5/1991 | Lemaster | |
| 5,033,951 | A | | 7/1991 | Cook | |
| 5,075,916 | A | | 12/1991 | Englehart | |
| D332,901 | S | | 2/1993 | Campbell | |
| 5,239,725 | A | | 8/1993 | White | |
| 5,240,394 | A | * | 8/1993 | James | 425/458 |
| 5,301,843 | A | | 4/1994 | Groene et al. | |
| 5,413,258 | A | | 5/1995 | Kartler | |
| 5,440,776 | A | | 8/1995 | Kartler | |
| 5,675,860 | A | | 10/1997 | Campbell | |
| 5,792,489 | A | | 8/1998 | Liberman | |
| 5,865,555 | A | | 2/1999 | Dawson | |
| 6,219,878 | B1 | | 4/2001 | Dewberry | |
| 6,305,926 | B1 | | 10/2001 | Ray | |

FOREIGN PATENT DOCUMENTS

| | | | |
|---|---|---|---|
| CH | 691284 | * | 6/2001 |
| DE | 19858383 | * | 9/1999 |
| GB | 385244 | | 8/1932 |
| GB | 844416 | | 8/1960 |
| GB | 2338503 | * | 12/1999 |
| WO | WO 94/27001 | | 11/1994 |

* cited by examiner

*Primary Examiner*—Mark Spisich

(57) ABSTRACT

A hand held tool comprised of an elongated triangular shaped elastomeric applicator tool (20) for spreading, smoothing and feathering filler material which can be utilized with a handle (30).

4 Claims, 6 Drawing Sheets

FILLER MATERIAL FINISHING TOOL

CROSS-REFERENCE TO RELATED APPLICATIONS

None

FEDERALLY SPONSORED RESEARCH

Not Applicable

SEQUENCE LISTING OR PROGRAM

Not Applicable

BACKGROUND OF THE INVENTION

1. Field of Invention

This invention relates to a hand held device utilized to smooth and feather filler material.

2. Background of the Invention

Home improvement and paint stores commonly supply customers with filler material to improve the appearance of their work. Such filler material is used around door trim, windows, baseboard, tubs, showers, sinks, imperfections in walls, corners and other areas where professional finished appearance and/or sealing is desirable. Originally filler material was commonly applied with one's finger, a stick, a spoon etc. Thereafter, inventors created several types of devices to accomplish the task. Some devices are used in conjunction with a caulking gun. Other devices are hand held but have various limitations. An effective tool to smooth and feather filler material, accommodate varying angles of intersection and irregular surfaces producing a professional appearance would be beneficial.

Several devices have been proposed, for example U.S. Pat. No. 6,305,926 B1 issued to Ray Oct. 21, 2001. The Ray device is placed on a finger to smooth filler material, care must be taken not to touch other areas where depositing filler material is undesirable or the device should be removed from one's finger and when use is again desired it will have to be re-placed on one's finger. U.S. Pat. No. 6,219,878 issued to dewberry Apr. 24, 2001 and U.S. Pat. No. 4,586,890 issued to Marchbanks necessitates excessive caulking to be applied for the tool to function properly. Both tools are designed to collect excess caulking resulting in waste and the necessity to clean and remove excess caulking from the tool. U.S. Pat. No. 5,792,489 issued to Liberman Aug. 11, 1998 has a plethora of parts making it expensive to manufacture and difficult to clean. U.S. Pat. No. 5,675,860 issued to Campbell Oct. 14, 1997 has limited flexibility as only the rim margin is formed of a flexible, resilient material around a handle; obtuse and acute joints would be difficult to apply filler material.

BACKGROUND OF THE INVENTION

Objects and Advantages

Accordingly, several objects and advantages of the present invention are:

a) to provide a tool which spreads, smoothes and feathers filler material to attain a professional finish;

b) to provide a tool which smooth and feathers filler material into acute, oblique and perpendicular joints;

c) to provide a tool with flexibility enabling conformity to surface variations;

d) to provide a tool which can be utilized without a handle for use in limited work areas;

e) to provide a tool with minimal components.

Further objects and advantages are to provide a filler material finishing tool which can be easily, conveniently and reliably used by both skilled craftsmen and novices "do-it-yourselfers". Still further objects and advantages will become apparent from a consideration of the drawings and ensuing description.

SUMMARY OF THE INVENTION

In accordance with the present invention, a filler material finishing tool, is comprised of an elongated triangular shaped elastomeric material utilized with or without a handle to smooth and feather filler material.

Also contemplated is a method of marketing a device to smooth and feather filler material by providing an elongated triangular shaped elastomeric piece that will smooth and feather filler material when drawn over said filler material, and providing a written instruction that the piece is capable of smoothing and feathering filler material when drawn over said filler material.

In other contemplated embodiments of the current invention, a caulk applicator is contemplated as having an elongated triangular shaped elastomeric piece that will smooth and feather filler material when drawn over said filler material, and the applicator is accompanied with a written instruction that the piece is capable of smoothing and feathering filler material when drawn over said filler material.

BRIEF DESCRIPTION OF THE DRAWINGS

Drawing Figures

In the drawings, closely related figures have the same number but different alphabetic suffixes.

REFERENCE NUMERALS IN DRAWINGS

Figure 1:
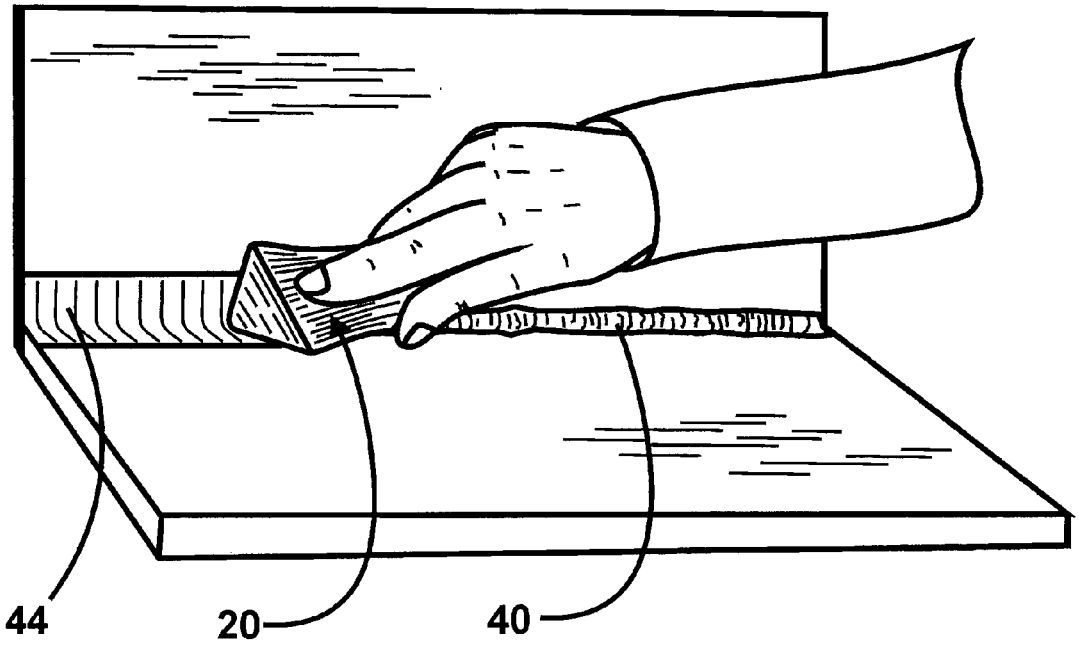
FIG. 1 is a perspective elevation of the tool in use.

20 filler material finishing tool
30 handle
40 filler material
44 smoothed filler material
50 front wall
52 back wall
54 top wall
56 side wall
58 side wall
60 front, top wall intersection
61 front wall angle of intersection with top
62 top, back wall intersection
63 edge formed by top, side wall intersection
64 edge formed by top, side wall intersection
65 edge formed by back, side wall intersection
66 edge formed by back, side wall intersection
68 front wall angle of intersection with side wall vertex
70 side wall angle of intersection with vertex
71 side wall vertex
72 top and side wall angle of intersection
73 top and side wall angle of intersection
80 convex vertex
82 flat vertex
84 concave vertex
90 tool side wall conforming to baseboard
92 planar surface
93 baseboard
94, 95 planar surfaces forming an obtuse joint
96, 97 planar surfaces forming an acute joint
98, 99 planar surfaces forming a small acute joint
102 oblique angle of intersection between two planar surfaces
104 acute angle of intersection between two planar surfaces
106 small acute angle of intersection between two planar surfaces

DETAILED DESCRIPTION OF THE INVENTION

Description—FIGS. 1, 7, 8 and 9—Preferred Embodiment

Figure 7A:
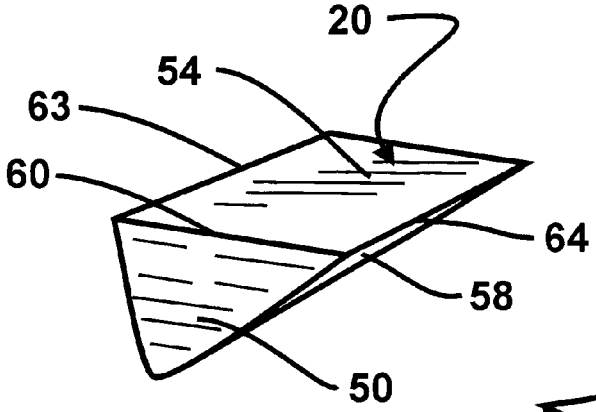
FIG. 7A is a perspective front elevation of the tool.
Figure 7B:
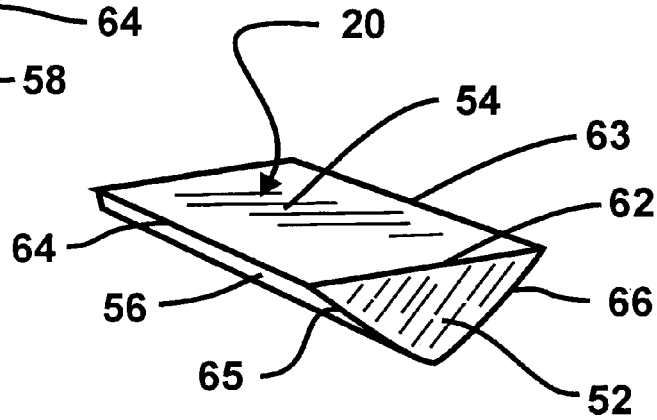
FIG. 7B is a perspective back elevation of the tool.
Figure 8:
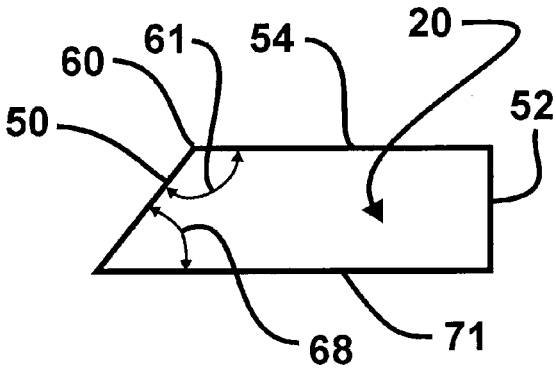
FIG. 8 is a side elevation of the tool.
Figure 9:
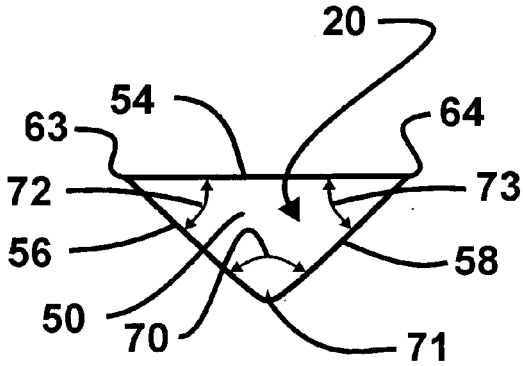
FIG. 9 is a front elevation of the tool.

A preferred embodiment of the filler material finishing tool of the present invention is illustrated in FIG. 1 (perspective view of use), FIG. 7A (perspective front elevation), FIG. 7B (perspective back elevation), FIG. 8 (side view) and FIG. 9 (front view). As seen in the drawings, the filler material finishing tool 20 comprises an elongated triangular shape of predetermined length formed of elastomeric material. Said elastomeric material may vary from very soft to firm enabling filler material finishing tool 20 to comply with the viscosity of filler material used. In the preferred embodiment, the filler material finishing tool 20 is formed of silicone. However the filler material finishing tool 20 can consist of any of a wide variety of elastomeric material such as, rubber, vinyl, foam, etc. It can be manufactured by extrusion and cut to a predetermined length or injection molded.

Figure 11A:
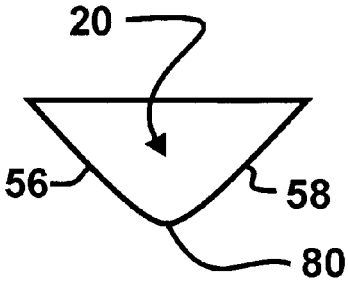
FIG. 11A is a front elevation of the tool to form a convex bead of filler material.

Front 50 (FIGS. 7A and 8) is typically inclined at an acute angle 68 with vertex 71 (FIG. 8). In FIG. 11A side walls 56, 58 join to form a convex side wall vertex 80. Top 54 intersects at an acute angle 72, 73 with sides 56, 58 (FIG. 9). As shown in FIG. 9 sides 56, 58 typically intersect forming an oblique angle 70 at vertex 71. Top, side walls typically intersect forming an acute angle 72, 73. FIG. 11A shows sides 56, 58 joining to form a rounded convex intersection 80 to smooth filler material in a concave shape. Back wall 52 (FIG. 7B) typically intersects top 54, and side walls 56, 58 (FIG. 9) at an approximate right angle at edges 62, 65 and 66. Front 50, top wall 54 intersection 60 (FIG. 7A, 8) typically forms an obtuse angle 61 (FIG. 8).

FIGS. 2, 3, 4, 5, 6, 7A, 10B, 10C—Additional Embodiments Additional embodiments are shown in FIGS. 2, 3, 4, 5, 6 10A and 10B in which a handle 30 is attached to the filler material tool 20.

Figure 10A:
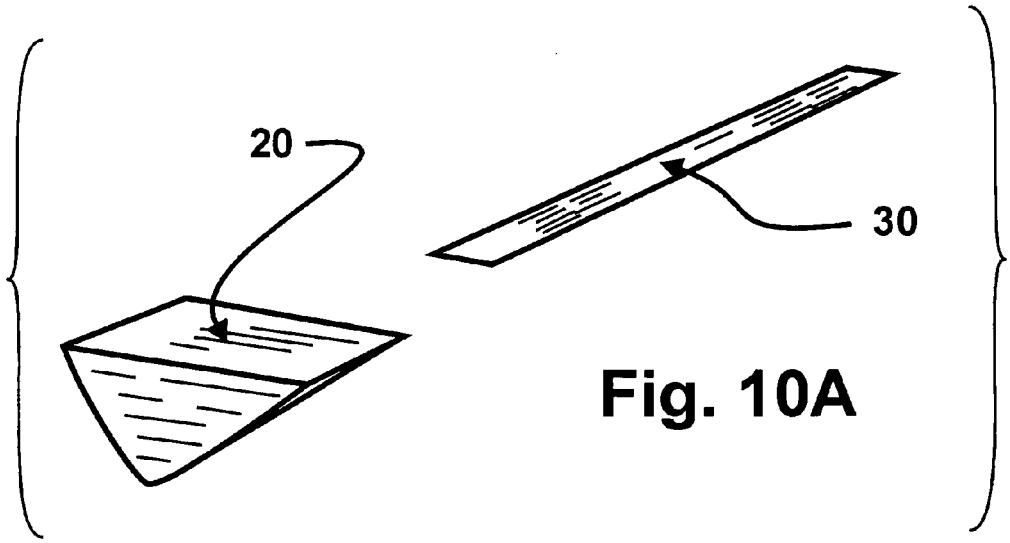
FIG. 10A is an exploded perspective elevation of the tool with a handle.
Figure 10B:
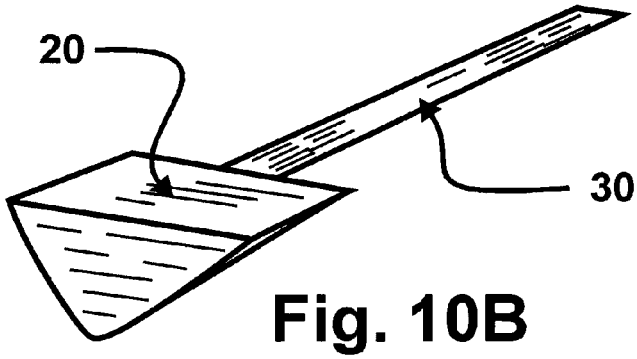
FIG. 10B is a perspective elevation of the tool with a handle.

FIGS. 10B, 10C—Alternative Embodiments

Figure 11B:
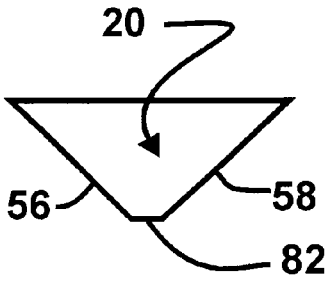
FIG. 11B is a front elevation of the tool to form a flat bead of filler material.
Figure 11C:
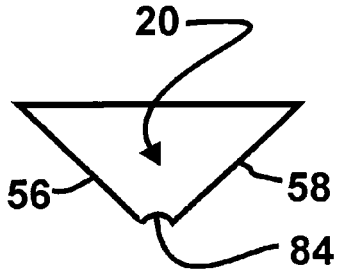
FIG. 11C is a front elevation of the tool to form a concave bead of filler material.

There are various possibilities with regard to the shape formed by the intersection of exterior surfaces forming edges of filler material finishing tool 20. Outer edges of tool 20 formed by the intersection of walls 50, 52, 54, 56 and 58 can be shaped in numerous configurations including sharp, beveled, concave and convex. FIG. 11B shows sides 56, 58 joining to form a flat sidewall intersection 82 to smooth filler material in a flat shape. FIG. 11C shows sides 56, 58 joining to form a concave sidewall intersection 84 enabling a convex formation of filler material.

Operation—FIGS. 1, 2, 3, 4, 5, 6

Typically filler material 40 is applied to a joint formed by the perpendicular intersection of two planar surfaces, tool 20 (FIG. 1) is held by one's hand drawing it along the joint smoothing and feathering filler material 44. When the tool 20 is drawn over filler material 44 vertex 71 (FIG. 9) disperses filler material outward, sides 56, 58 (FIG. 7A, 7B, 9) smooth and feather it. Filler material finishing tool 20 as shown in FIG. 1 without a handle is well suited for use in confined working spaces.

Figure 2:
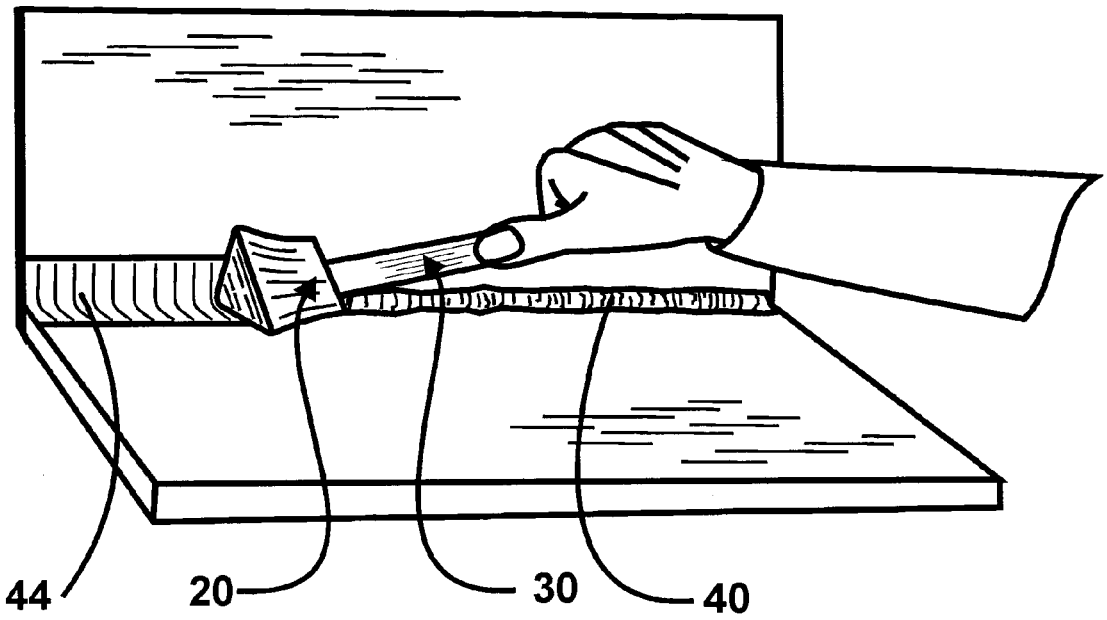
FIG. 2 is a perspective elevation of the tool in use with a handle.

FIG. 2 shows tool 20 in use with handle 30 attached. Handle 30 provides the user enhanced ease of use and control of tool 20.

Figure 3:
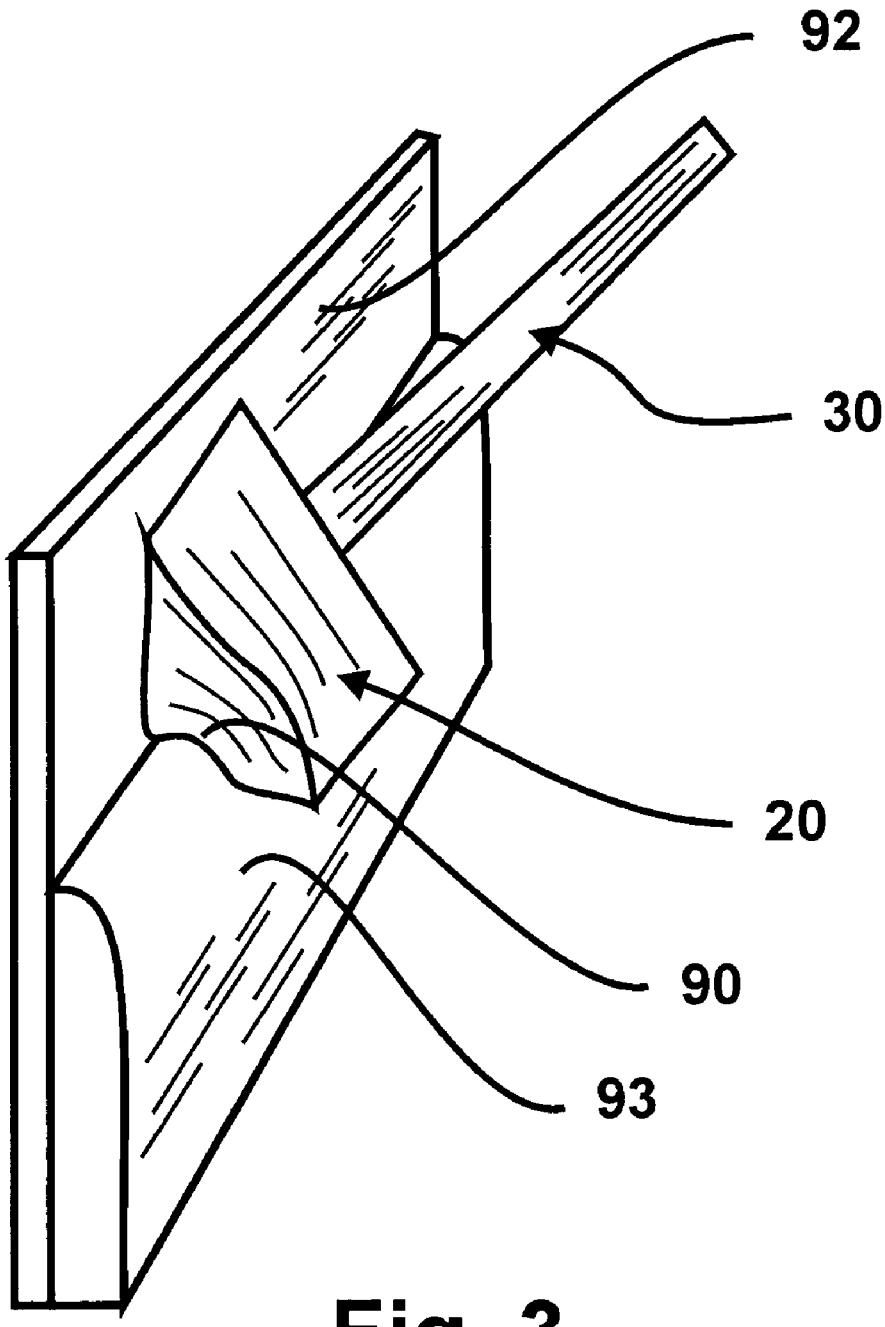
FIG. 3 a perspective elevation of the tool with a handle in use applying filler material to a all and baseboard joint.

In FIG. 3 tool 20 is shown inserted at the joint of a planar surface 92 and baseboard 93 illustrating the ability of the tool's elastomeric properties to conform to irregular surfaces 90.

Figure 4:
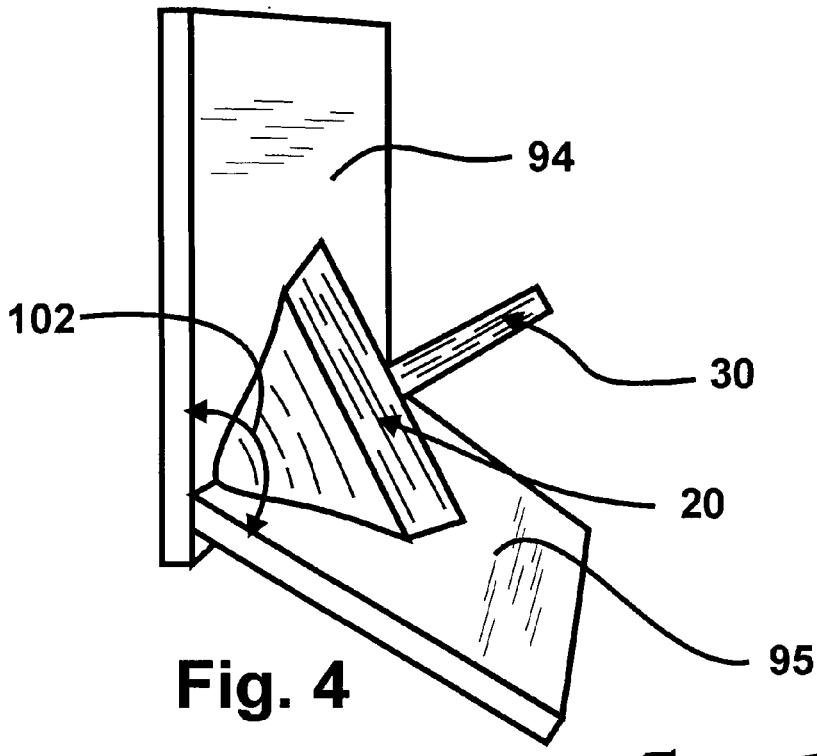
FIG. 4 is a perspective elevation of the tool with a handle attached inserted in an obtuse angle of intersection of two planar surfaces.

As shown in FIG. 4 the tool's 20 elastomeric properties enables it to conform to oblique angles of intersection 102 between two planar surfaces 94, 95.

Figure 5:
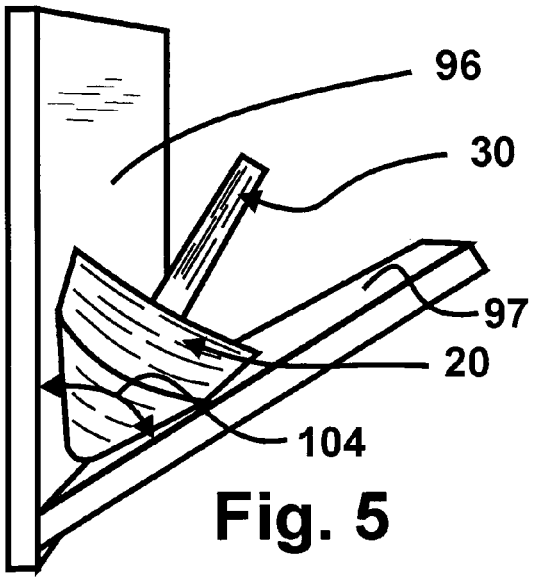
FIG. 5 is a perspective elevation of the tool with a handle attached inserted in an acute angle of intersection of two planar surfaces.

As shown in FIG. 5 the tool's 20 elastomeric composition enables it to conform to acute angles of intersection 104 between two planar surfaces 96, 97.

Figure 6:
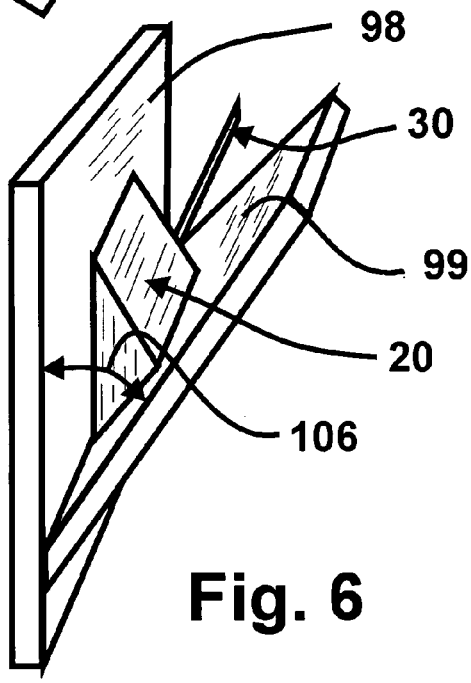
FIG. 6 is a perspective elevation of the tool with a handle attached inserted on edge in a small acute angle of intersection of two planar surfaces.

In FIG. 6 the tool 20 is shown with edge 63 (FIG. 9) inserted in a small acute angle 106 (FIG. 6) of intersection between two planar surfaces 98, 99 (FIG. 6). Both edges 63 and 64 can be utilized to apply filler material from opposite directions in a limited working space.

Advantages

From the description above, a number of advantages of my filler material finishing tool become evident:

(a) The filler material finishing tool can be used without a handle to apply filler material in a confined space.

(b) The filler material finishing tool can be used with a handle when space permits providing superior control of the tool.

(c) The filler material finishing tool comprised of elastomeric material provides the ability for the "do-it-yourselfer" to attain smoothed and feathered filler material with professional results.

(d) Elastomeric composition of the filler material finishing tool enables the user to apply filler material perpendicular joints and irregular joints surfaces such as that formed by baseboard and wall joint, obtuse joints, acute joints and small acute joints.

Conclusion, Ramifications, and Scope

Accordingly, the reader will see that the filler material finishing tool of this invention can be used to easily and conveniently apply filler material with professional results. Furthermore, the filler material finishing tool has the additional advantages in that:

it provides for smoothing and feathering filler material;

it provides a tool for applying filler material to joints formed with various intersecting angles;

it provides a tool for applying filler material in open and confined work space.

Although the description above contains may specificities, these should not be construed as limiting the scope of the invention but as merely providing illustrations of some of the presently preferred embodiments of this invention. Many other variations are possible. For example the back of filler material finishing tool may intersect with the top and sides at other than a perpendicular angle; the front may join the vertex in an obtuse angle; sides, top, front and back may be formed by a curved surface, etc. It is to be understood, however, that there is no intention to limit the invention to the particular form disclosed. On the contrary, the intention is to cover all modifications, equivalences and alternative constructions falling within the spirit and scope of the invention. Thus the scope of the invention should be determined by the appended claims and their legal equivalents, rather than by the examples given.

What I claim as my invention is:

1. A device for smoothing and feathering a filler material between two intersecting surfaces, comprising:

an elongated elastomeric body having a substantially triangular cross-section taken along the length thereof, said body including substantially planar front and back walls at opposite ends of the body, said body further including a top wall and a pair of sidewalls which define the triangular cross-section and Which extend the length of the body between the front and back walls thereof, each of the top and side walls being substantially planar:

each of the sidewalls defining an acute angle on opposite sides of the top wall and further meeting at an apex defining an obtuse angle between them, said back wall being substantially perpendicular to the top wall and the front wall angled back from a bottom portion of the body opposite the top wall towards the back wall such that the length of the apex defined by the side walls is longer than the top wall, the front wall defining an acute angle with the apex of the side walls and an obtuse angle with the top wall; and wherein the body is adapted to be drawn over the filler material between the intersecting surfaces so as to smooth and feather the filler material.

2. A device as in claim 1 and further including a handle attached to the body.

3. A caulk device, comprising:

an elongated elastomeric body having a substantially triangular cross-section taken along the length thereof, said body including substantially planar front and back walls at opposite ends of the body, said body further including a top wall and a pair of sidewalls which define the triangular cross-section and which extend the length of the body between the front and back walls thereof, each of the top and side walls being substantially planar:

each of the sidewalls defining an acute angle on opposite sides of the top wall and further meeting at an apex defining an obtuse angle between them, said back wall being substantially perpendicular to the top wall and the front wall angled back from a bottom, portion of the body opposite the top wall towards the back wall such that the length of the apex defined by the side walls is longer than the top wall, the front wall defining an acute angle with the apex of the side walls and an obtuse angle with the top wall; and wherein the body is adapted to be drawn over filler material between intersecting surfaces so as to smooth and feather the filler material.

4. A caulk device as in claim 3 and further including a handle attached to the body.

* * * * *